United States Patent [19]

Liu

[11] Patent Number: 4,836,751

[45] Date of Patent: Jun. 6, 1989

[54] DETACHABLE ELECTRIC FAN

[76] Inventor: Ssu-Liu Liu, 2/F., No. 218, Chung Hsiao E. Rd., Sec. 4, Taipei, Taiwan

[21] Appl. No.: 223,823

[22] Filed: Jul. 25, 1988

[51] Int. Cl.[4] ..... F04D 29/70

[52] U.S. Cl. ..... 416/247 R; 403/24

[58] Field of Search ..... 416/247 R, 247 A, 246; 415/219 R; 403/24

[56] References Cited

U.S. PATENT DOCUMENTS

| | | | |
|---|---|---|---|
| 2,433,280 | 12/1947 | Koch et al. | 416/247 R |
| 2,498,968 | 2/1950 | Viewegh | 416/247 R |
| 3,787,142 | 1/1974 | Dupke | 416/247 R |
| 4,732,539 | 3/1988 | Shin-Chin | 416/246 |
| 4,746,273 | 5/1988 | Sun | 416/246 |

FOREIGN PATENT DOCUMENTS

| | | | |
|---|---|---|---|
| 2560940 | 9/1985 | France | 403/24 |
| 135797 | 10/1981 | Japan | 416/247 R |

*Primary Examiner*—Robert E. Garrett
*Assistant Examiner*—John T. Kwon
*Attorney, Agent, or Firm*—Vardell Legal Group

[57] ABSTRACT

A detachable electric fan and more particularly a built-up electric fan comprising component parts of detachable stand and one set of built-up blade-protective covers for easy carriage and storage; a stand being consisted of a transverse base plate having a connection trough at the top in the center with rib channels provided, and an independent vertical frame plate having a control switch button set mounted thereon and elastic retainers and reinforcing ribs at the bottom for connection with the base plate; the blade-protective cover symmetrically arranged, each blade-protective cover being composed of two semi-circular cover plates with one symmetric set of pin holder and locking pin for easy assembly, each blade-protective cover being supported with a circular supporting plate by bolts, the rear blade-protective cover having an axial hole for insertion of motor shaft to let the fan blades be well protected; by the built-up component parts to form a detachable electric fan for easy carriage and to reduce the storage space and manufacturing cost.

3 Claims, 4 Drawing Sheets

DETACHABLE ELECTRIC FAN

BACKGROUND AND SUMMARY OF THE INVENTION

The detachable structure of the present invention is mainly to improve the shortcomings of the fixed size of conventional electric fans being not convenient for carriage and transportation. Therefore, the present invention is to change the fixed style of conventional fan stands and blade covers into a detachable design, that is to provide a stand to be built-up with a transverse base plate and a vertical frame plate by means of the connection of rib channels of the retaining trough of the transverse base and the reinforcing ribs of the retainer portion of the vertical frame plate, and to provide a fan blade cover composed of a front blade-protective cover plate and a rear blade-protective cover plate, each cover plate is built-up with two symmetric pieces of semi-circular cover plates, and the central plate of each pair of semi-circular cover plate comprises one set of pin holder and locking pin in a position for easy assembly of said two semi-circular cover plates into one full piece of blade-protective cover plate. By means of this arrangement, the electric fan according to the present invention can be detached to reduce the space for easy carriage and storage.

In the modern time, while purchasing an article, consumers request not only good application but also new variation and high practicability. Therefore, the manufacturers are spare no energy in R&D to create attractive and new design. Although regular electric fans are variable in appearance and design, they mainly are composed of a fan stand, a motor, one set of an blades and one set of blade cover. In order to match with the fan blades and the blade cover, the stand of regular electric fan has a vertical frame portion protruding upward from the stand base in a fixed type, which occupies a big space and is not detachable. Further, the blade cover of regular electric fan is mainly composed of two symmetric cover plates, and each cover plate still occupies a big space even if it is detached. Therefore conventional electric fan requests a big space for storage and is not convenient for carriage and transportation. Furthermore, the manufacturing cost for each component parts of the conventional electric fans is relatively expensive. Although there are mini fans available in the market, these mini fans are all of fixed type and not detachable, in practice, they still can not meet consumers' requirements.

In view of the problems above-mentioned and after a long period of experimentation, the present invention has finally been created to provide a detachable electric fan to reduce its size for convenience of storage and carriage.

The main object of the present invention is to provide a detachable electric fan, by means of a vertical frame plate and a transverse base plate to form a fan stand, by means of two semi-circular cover plates to form a front blade-protective cover and a rear blade-protective cover for assembly into a blade cover, and by means of said arrangement to reduce the size for easy carriage and storage.

DETAILED DESCRIPTION OF THE PREFERRED EMBODIMENT

Figure 1:
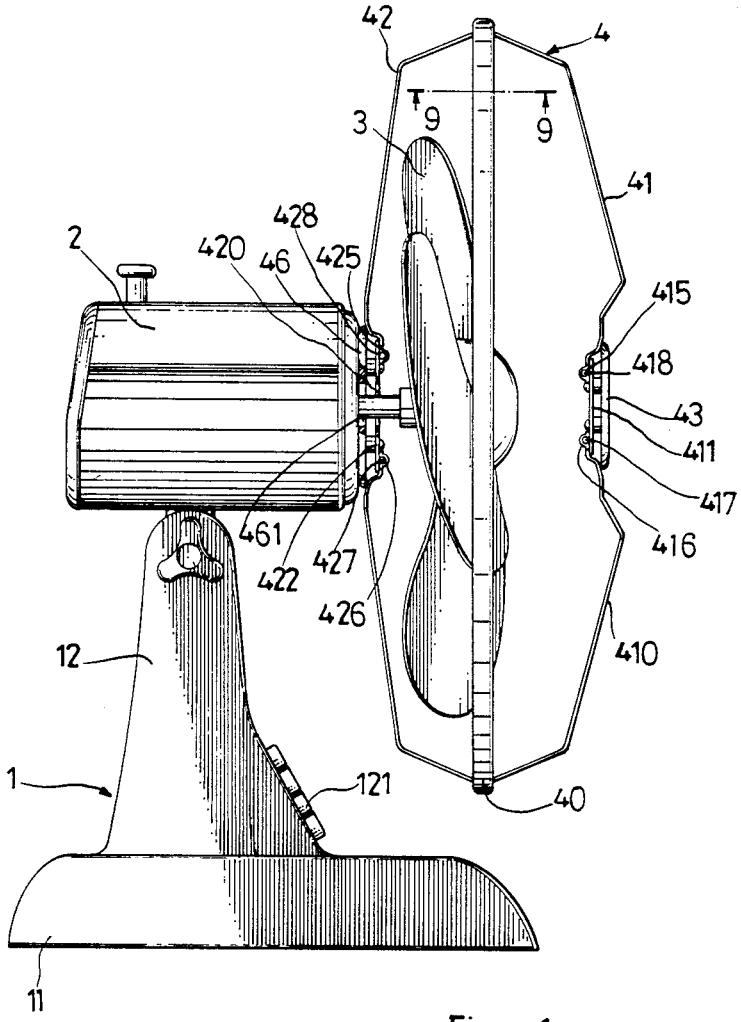
FIG. 1 is a schematic drawing of a detachable electric fan embodying the present invention.

Referring to the schematic drawing of the present invention as shown in FIG. 1, the detachable electric fan is composed of a stand 1, a fan motor 2, a blade cover 4 and fan blades 3.

Figure 2:
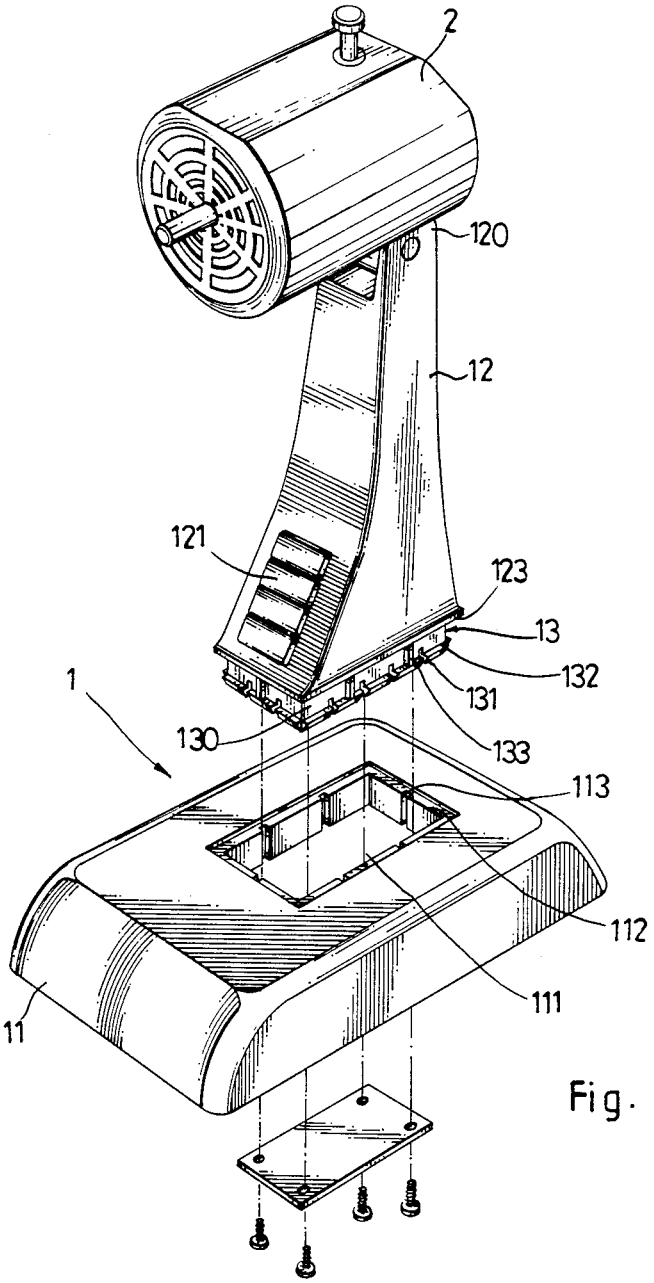
FIG. 2 is a fragmentary structural view of the built-up fan stand according to the present invention.
Figure 3:
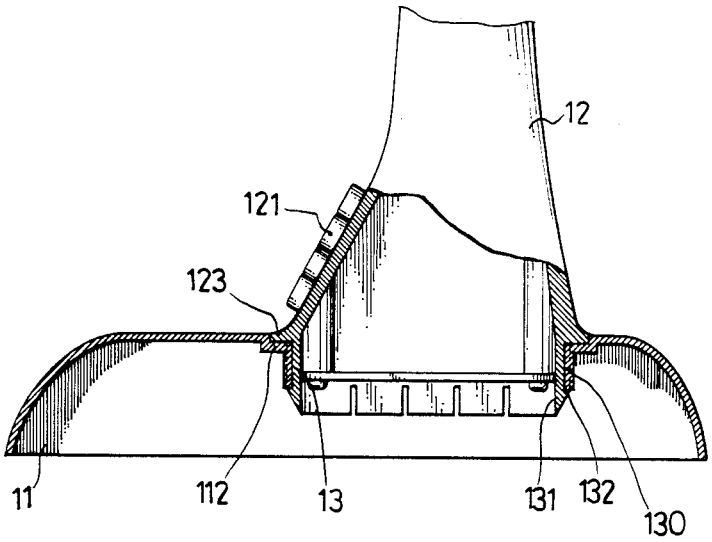
FIG. 3 is a partly cross-sectional view of the built-up fan stand according to the present invention.

Referring to FIG. 2, the stand 1 is composed of a base plate 11 and a vertical frame plate 12. Said base plate 11 is arranged as a transverse member to stabilize the built-up fan, comprising a stepped trough 111 at the top in the center, said stepped trough 111 has an upper check edge 112 at the top and a plurality of rib channels 113 around the wall surface of the four sides to aim at the corresponding portion of the vertical frame plate 12 for connection. Said vertical frame plate 12 is protruding upward, having one pair of protruding lugs bilaterally at the top for fixation of said fan motor 2, and one set of controls switch buttons 121 to connect with the upper fan motor 2 for controlling the revolving of the fan blades. An electric power line is connected with one end to the control switch buttons 121 and with the other end penetrating beyond the vertical frame plate through the lower back portion to let the vertical frame plate 12 be detachable from the transverse base plate 11. Said vertical frame plate 12 has an extended retaining portion 13 at the bottom in reduced size letting the bottom edge of the frame plate 12 form a upper check edge 123 such that the upper check edge 123 of the vertical frame plate 12 stops at the upper check edge 112 of the transverse base plate 11, the retaining portion 13 is arranged to have a separated elastic retainers 131 at its lower check edge 132 to facilitate the connection of the vertical frame plate 12 with the transverse base plate 11 in the trough 111. By means of the arrangement of the upper check edge 123 and the lower check edge 132 to form a recessed space 130 in a height corresponding to the depth of the trough 111 of the base plate (as shown in FIG. 3), and a plurality of reinforcing ribs 133 are arranged on the wall surface around the four sides of the recessed space 130 to match with the rib channels 113 such that the reinforcing ribs 133 are inserted into respective rib channels 113 to strengthen the connection of the transverse base plate 11 and the vertical frame plate 12 when they both are assembled into one fan stand.

Figure 9:
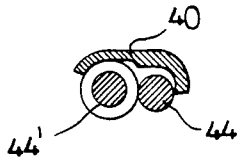
FIG. 9 is an assembly sectional view of the fan cover and the pressure ring plate for the preferred embodiment according the present invention.
Figure 4:
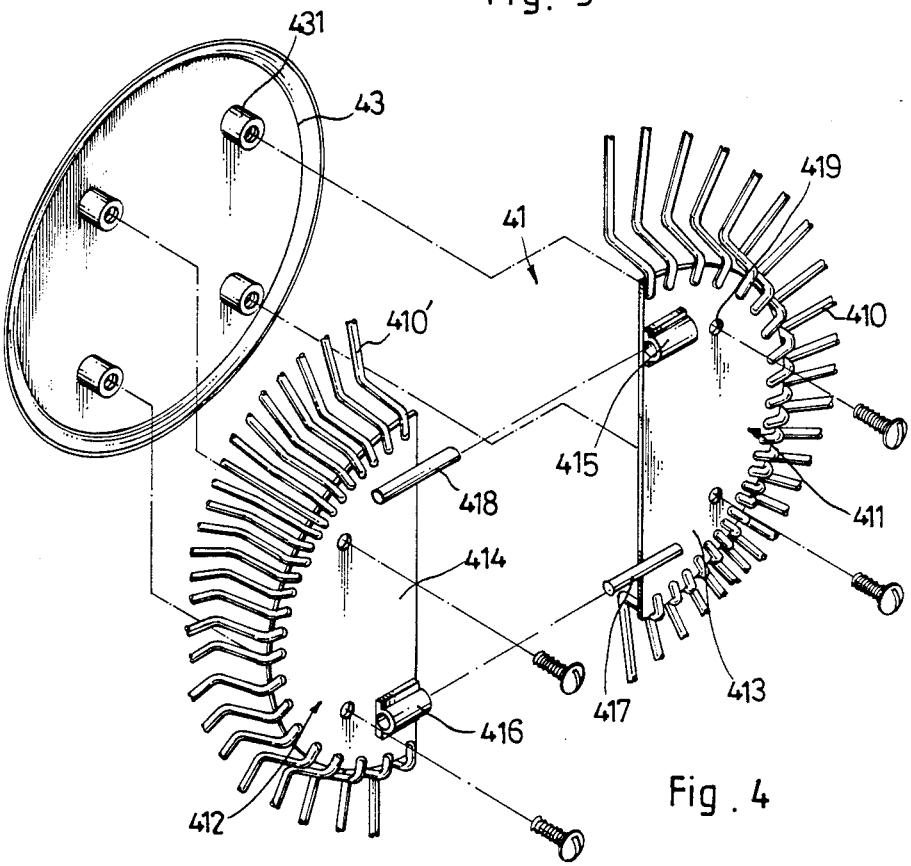
FIG. 4 is a partly fragmentary structural view of the front blade cover of the preferred embodiment according to the present invention.
Figure 8:
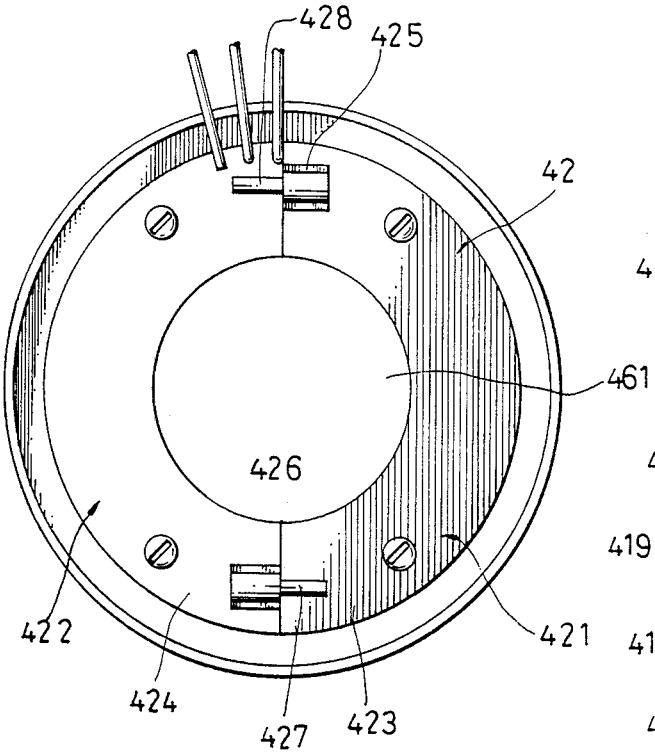
FIG. 8 is an assembly sectional view of the front and rear blade-protective covers and the corresponding locating plate.
Figure 5:
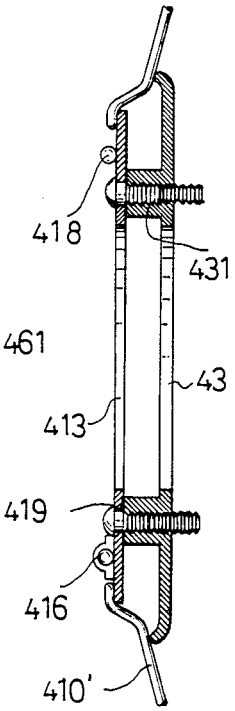
FIG. 5 is a partly sectional view of the assembly of the half portion of the front blade-protective cover with the circular supporting plate.
Figure 7:
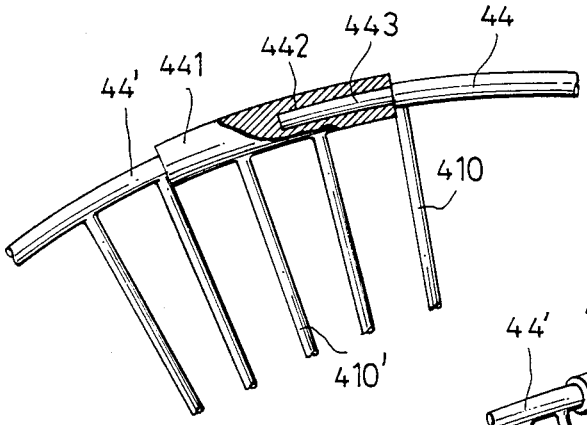
FIG. 7 is a front assembly view of the rear blade-protective cover.
Figure 6:
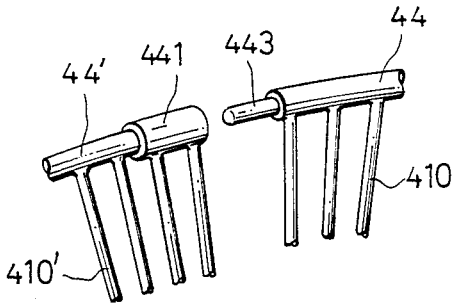
FIG. 6 is a schematic drawing illustrating the peripheral frame structure of the front and rear blade-protective covers.

Please refer to FIGS. 4–7 and FIG. 1 regarding the assembly of the fan cover. The blade cover 4 is as seen in regular electric fans, composed of a front blade-protective cover 41 and a rear blade-protective cover 42 arranged in a detachable way. Said front blade-protective cover 41 is assembled with two symmetric semi-cover plates 411, 412 (as shown in FIG. 4). Each of said semi-cover 411, 412 comprises a semi-circular central plate 413, 414 to match with the other semi-circular central plate 414, 413 of the other semi-cover plate 412, 411 to form a circular cover plate. Said central plate 413, 414 comprises raidal ribs 410, 410' at equal intervals around the curved portion, a locking pin 417, 418 and a pin holder 415, 416 arranged by the side of the straight edge. The pin holder 415 and the locking pin 417 of the central plate 413 are arranged to match with the locking pin 418 and the pin holder 416 of the other central plate 414 such that said two central plates 413, 414 can be attached together to let the corresponding two semi-cover plates 411, 412 be connected into a front blade-protective cover 41. After the assembly of the front blade-protective cover 41, it is supported by a supporting circular plate 43 by means of bolts through the bolt holes 431 of the supporting circular plate 43 and the holes 419 of the cover plates 411, 412. Said radial ribs 410, 410' of the cover plates 411, 412 are connected together by means of a respective semi-circular frame ring plates 44, 44' around the periphery, one end of each frame ring plate 44, 44' comprises a socket element 441 having an inner hole 442 and the other end of the plate 44, 44' comprises an extended plug portion 443 (as shown in FIG. 6) such that the frame ring plate 44 and the frame ring plate 44' can be attached into one circular ring plate for fixation around the cover plates 411, 412. Said rear blade-protective cover 42 has same structure as the front blade-protective cover 41, composed of two semi-cover plates 421, 422 by means of the connection of two symmetric central plates 423, 424 through respective locking pins 427, 428 and pin holders 425, 426 and supported by a circular supporting plate 46. For allocation of fan blades and motor shaft, said rear blade-protective cover is arranged to comprise axial holes 416, 420 through the central plates 423, 424 and the supporting plate 46. For fixation of said front and rear blade-protective covers, a pressure ring belt 40 is provided to mount on the frame ring plates 44, 44' of the front and rear blade-protective covers 41, 42 (as shown in FIG. 9).

In general, the stand 1 of the electric fan according to the present invention, can be detached into a transverse base plate 11, a vertical frame plate 12, the fan cover 4 can be detached into four pieces of semi-circular plates 411, 412, 421, 422. By means of this arrangement, the storage space can be reduced to 50% for easy carriage and transportation, and further, the materials can be minimized to reduce manufacturing cost.

I claim:

1. A detachable electric fan composed of a stand, a fan motor, one set of fan blades, and a fan cover, characterized in that said stand comprising a detachable transverse base plate and a vertical frame plate, said transverse base plate comprising a stepped trough with an upper check edge provided at the top and a plurality of rib channels arranged on the wall surface around the four sides of the trough to match with the lower protruding portion of the vertical frame plate, said vertical frame plate comprising a closed type of control switch button set; the front and rear blade-protective cover plates of said fan cover being respectively composed of one pair of symmetric semi-cover plates, each of said semi-cover plate comprising a semi-circular central plate, the semi-circular central plate of the front blade-protective cover plate being completely closed, and the semi-circular central plate of the rear blade-protective cover plate comprising an axial hole for insertion of motor shaft, the arc portion of each semi-circular central plate comprising one set of raidal ribs around the periphery at equal intervals, said radial ribs being connected together by means of a frame ring plate, said frame ring plate comprising a socket at one end and a extending plug portion at the other end to match with the other frame ring plateof the other semi-circular central plate, each of semi-circular central plate also comprising by the straight edge a locking pin and a pin holder to reciprocally match with the pin holder and the locking pin of the other central plate for fixation of said two central plates into one circular plate to form a front blade protective cover plate or a rear blade-protective cover plates being respectively assembled, they both being connected together and respectively supported by one inner supporting plate having plurality of bolt holes and another inner supporting plate having a plurality of bolt holes and one axial hole by means of bolts through said bolt holes and the connection holes of the respective central plates and then the periphery of both blade-protective cover plates being tightly connected together by a pressure ring belt to complete the assembly.

2. A detachable electric fan according to claim 1 wherein the bottom retaining portion of said vertical frame plate protrudes downward in a reduced size and comprises a lower check edge having a plurality of elastic retainers to form a recessed space with the upper check edge of the vertical frame plate, said recessed space comprising a plurality of reinforcing ribs on the wall surface around the four sides to match with the rib channels of the trough of the tranverse base plate.

3. A detachable electric fan according to claim 1 wherein said rib channels and said reinforcing ribs being respectively arranged on the four sides of the wall surface of the trough of the base plate and the retaining portion of the vertical frame plate in a reciprocal way such that each rib being inserted into a respective rib channel upon fixation of said transverse base plate with said vertical frame plate to strengthen the stability of the assembly.

* * * * *